US008746461B2

(12) United States Patent
Gaus

(10) Patent No.: US 8,746,461 B2
(45) Date of Patent: Jun. 10, 2014

(54) FILTER FOR CLEANING MACHINES

(75) Inventor: Bruno Gaus, Offenburg (DE)

(73) Assignee: Meiko Maschinenbau GmbH & Co. KG, Offenburg (DE)

( * ) Notice: Subject to any disclaimer, the term of this patent is extended or adjusted under 35 U.S.C. 154(b) by 1412 days.

(21) Appl. No.: 12/030,721

(22) Filed: Feb. 13, 2008

(65) Prior Publication Data

US 2008/0210621 A1 Sep. 4, 2008

Related U.S. Application Data

(60) Provisional application No. 60/907,329, filed on Mar. 28, 2007.

(30) Foreign Application Priority Data

Feb. 13, 2007 (DE) ..... 10 2007 007 134

(51) Int. Cl.
*B01D 35/02* (2006.01)
*A47L 15/42* (2006.01)

(52) U.S. Cl.
CPC ..... *A47L 15/4204* (2013.01); *A47L 15/4202* (2013.01); *A47L 15/4208* (2013.01)
USPC ..... 210/416.1; 134/104.1

(58) Field of Classification Search
CPC ..... A47L 15/4202; A47L 15/4204
USPC ..... 134/104.2, 104.4, 109, 110, 111, 10; 210/498, 521
See application file for complete search history.

(56) References Cited

U.S. PATENT DOCUMENTS

| | | | | |
|---|---|---|---|---|
| 1,605,961 A | | 11/1926 | Loew | |
| 3,533,841 A | | 10/1970 | Radach | |
| 3,585,128 A | | 6/1971 | Hoffman | |
| 4,686,040 A | * | 8/1987 | Nilsson | 210/331 |
| 4,998,548 A | * | 3/1991 | Lagerstrand | 134/111 |
| 5,450,868 A | * | 9/1995 | Young, Jr. | 134/111 |
| 6,079,427 A | | 6/2000 | Perry | |
| 6,083,392 A | * | 7/2000 | Rigney | 210/451 |

FOREIGN PATENT DOCUMENTS

| | | |
|---|---|---|
| DE | 1428358 | 11/1968 |
| DE | 2240461 A1 | 2/1974 |
| DE | 2451822 C2 | 11/1982 |
| DE | 69820625 T2 | 11/2004 |
| EP | 0976359 A1 | 2/2000 |
| EP | 0990413 A1 | 4/2000 |
| EP | 0990413 A1 | 11/2002 |
| EP | 1256308 A2 | 11/2002 |

* cited by examiner

*Primary Examiner* — Tony G Soohoo
*Assistant Examiner* — Peter Keyworth
(74) *Attorney, Agent, or Firm* — Muncy, Geissler, Olds & Lowe, P.C.

(57) ABSTRACT

The invention relates to a filter insert (36, 66) for cleaning machines, in particular continuous-flow dishwashers (10), in which a batch to be cleaned runs through at least one treatment zone. The at least one treatment zone is assigned a washing tank (12). The filter insert (36) has a number of longitudinal ribs (38) which run parallel to one another and delimit flumes (48).

19 Claims, 3 Drawing Sheets

FILTER FOR CLEANING MACHINES

This nonprovisional application claims priority to German Patent Application No. DE 102007007134, which was filed in Germany on Feb. 13, 2007, and to U.S. Provisional Application No. 60/907,329, which was filed on Mar. 28, 2007, and which are both herein incorporated by reference.

PRIOR ART

In automatic cleaning machines, in particular continuous-flow dishwashers, with a plurality of tanks, the washing water tanks of the washing zone are filled with fresh water and heated up. Furthermore, cleaning agent is added to the stored washing water. In multitank dishwashers, in particular continuous-flow dishwashers, a plurality of washing zones may be arranged one behind the other, the washing water of which has, for example, different temperatures with different cleaning agents, and/or with different cleaning agent concentrations. A washing zone is generally designed as a chamber and typically has an inlet port and an outlet port. The batch is transported through the respective washing zone by means of the conveying device through these ports. In general, a washing zone has a washing water tank and a circulating pump which sucks in washing water from the washing water tank and sprays it, via a spray system assigned to the washing zone, onto the batch to be cleaned. In this case, the dirt adhering to the batch is removed. Subsequently, the washing water, together with the washed-off dirt, flows back into the washing water tank again. In this case, the washed-off dirt is filtered out of the washing water by means of a screen system. Usually, in this case, screen plates with hole diameters of 2 mm to 4 mm are used, which cover the entire washing water tank. Dirt fractions which are smaller than these hole diameters are circulated together with the washing water.

Subsequently, in the continuous-flow dishwasher, cleaning agent and dirt residues which lie loosely on the batch are washed off by means of fresh water in one or more rinsing-clear zones. The fresh water may be cold or warmed-up hot fresh water. A rinsing-clear agent may in this case be added additionally to warmed-up fresh water. The fresh water or rinsing-clear water is subsequently supplied mostly completely or partially to a washing water tank of a washing zone, in order to dilute the dirt fractions located there in the washing water tank. After running through the one or more rinsing-clear zones, the batch to be cleaned optionally runs through one or more drying zones, in which the batch is dried.

The abovementioned screen plates in the at least one washing zone often have the disadvantage that the dirt filtered out of the washing water remains lying on these and is not actively removed from the washing zone. By the washing water falling down, this dirt may be further comminuted and then likewise passes, with a time delay, into the washing water of the washing zone and increases the dirt content of the washing water there. This is a disadvantage particularly because the respective cleaning capacity of a washing zone typically decreases with the quantity of dirt in the circulated washing water.

The dirt content of the washing water of the washing zone may be counteracted by an increase in the fraction of rinsing-clear water from the rinsing-clear zone which is supplied to the washing zone. The disadvantage of this, however, is that, in this method, the consumption of cleaning agent which has to be added to the washing water and also the required heating capacity rise in the same ratio. Operating costs and environmental pollution grow as a result.

A further possibility of reducing the dirt fraction in the washing water of the washing zone is to use screen plates of smaller hole diameter in the washing zone. However, with a smaller diameter of the screen plates, the risk that the screen plate becomes blocked rises. A partial or complete blockage of the screen plate has the effect, however, that sufficient washing water no longer flows back into the washing water storage tank, with the result that the pump pressure by which the batch is acted upon with washing water decreases and therefore the washing action is adversely influenced.

If a certain dirt content in the washing water is overshot in the washing zone in spite of the conventionally used screen plates and the supply of rinsing-clear water from the rinsing-clear zone, then, as a rule, the entire washing water tank content has to be changed. This entails costs to fresh water and sewerage. Furthermore, this, as a rule, means a stoppage time for the continuous-flow dishwasher machine, and also increased personnel costs for cleaning the respective washing zone and costs for heating energy for heating the washing water to the preset temperature of the order of 60° C., and also costs for the new cleaning agent which has to be added to the washing water again.

From the sector of single-chamber dishwashers, filter systems are known in which the washing water storage tank is likewise covered by a screen plate. In one region of the screen plate, however, a coarse screen is used which is followed by a fine screen. The washing water is likewise circulated within the "washing" program steps. Part of the washing water, after running through the coarse screen, flows through the fine screen. In this, even the fine dirt fractions of the washing water are retained. When the washing water is changed, a sewerage pump conveys the washing water, together with the fine and coarse dirt, out of the fine screen into the sewerage.

An apparatus of this type is described in DE 24 51 822 C2. The apparatus described in this publication discloses a collecting pot for a dishwasher with a first suction intake space connected to a lye pump and with a second suction intake space connected to a circulating pump. The first and the second suction intake space are in this case connected to one another by means of a fine filter screen. In a suction intake step, washing liquid is sucked away from the dishwasher, washing liquid being drawn off from both suction intake spaces by means of the lye pump.

A further configuration of a single-chamber dishwasher is illustrated in DE 14 28 358. This embodiment additionally has spray nozzles which spray from outside onto a fine filter, with the result that the fine filter is cleaned and dirt residues can be removed by means of a sewage pump. A similar self-cleaning principle, in which a filter element is cleaned by means of a spray nozzle, is also disclosed in EP 0 976 359 A1 and DE 69 820 625 T2. EP 1 256 308 A2 relates to an apparatus which in addition to a spray nozzle also additionally has a dirt comminutor.

The apparatuses known from the prior art typically function to the effect that washing operation is interrupted for a cleaning of the fine screen. In this case, a separate program step of fine screen cleaning is carried out, with the washing water pump switched off. This is due particularly to the fact that, in the apparatuses described, during washing operation a washing liquid constantly flows through the fine screen in a filter direction, so that the fine screen is not directly accessible for cleaning (for example, spraying from outside). This interruption in washing operation for cleaning the screens used therefore signifies an additional amount of time during which the respective washing chamber cannot be used.

The embodiments described, known from the prior art, therefore have in common the fact that they are designed for use in single-tank water changing machines and cannot readily be transferred to a continuously operating washing zone of a continuous-flow dishwasher having a plurality of tanks. In a continuous-flow dishwasher having a plurality of tanks, a washing water circulating pump operates permanently, relatively large washing water quantities per minute being circulated, and therefore relatively large quantities of washing water flowing constantly into the fine filter. Cleaning of the screens used, for example by spraying, particularly in a separate cleaning step, can be implemented only with difficulty in technical terms in such a type of operation, and, particularly in the case of commercial applications, would lead to washing operation which has a large number of interruptions and is therefore costly.

DISCLOSURE OF THE INVENTION

The object on which the present invention is based is to provide a filter device which avoids the disadvantages of the abovementioned solutions from the prior art.

According to the invention, a filter insert is proposed which is preferably arranged below a coarse screen or the like in the washing tank of a washing zone of a continuous-flow dishwasher and which is provided with a number of longitudinal ribs disposed in a regular division. The longitudinal ribs extend in a direction in which the bottom of the filter insert, which has flumes lying between the longitudinal ribs, is inclined. This means that the filter insert, which is preferably of box-shaped design and can be suspended in a simple way in the washing tank of a continuous-flow dishwasher, has a gradient which is suitable for effecting in the flumes a flushing-away of particles intercepted there into a separate filter box.

Preferably, the filter insert has longitudinal ribs arranged in a regular division and running in the longitudinal direction correspondingly to the flow gradient formed. These longitudinal ribs have an essentially triangular appearance and extend with their side faces from a ridge at a taper angle of up to 35° to their corresponding standing face on the top side of the flumes. The division in which the longitudinal ribs are arranged in the filter insert results in a corresponding number of flumes. The flumes are preferably formed in the closed bottom with a lateral margin, thus affording a sufficient film of washing water which allows particles to be flushed away and which flows to each outflow orifice formed in a flume or to a common orifice, below which is arranged a filter box for receiving the particles flushed away. The filter box below the filter insert may, for example, be designed in the form of a box in a simple way in manufacturing terms and have a separate conveying assembly.

Whereas the individual flumes extending between the longitudinal ribs of the filter insert have a closed surface an orifice pattern is formed in the side faces of the individual longitudinal ribs. This orifice pattern is preferably selected such that larger dirt particles do not pass through it, but, instead, impinge, laterally of the side faces arranged at the taper angle with respect to one another, onto the flumes, by which they are transported away, by the flume water film forming there, in the direction of the outflow orifices. The orifice-pattern in the side faces delimiting the longitudinal ribs is designed in a size of 1 to 3 mm, which, although allowing washing liquid to pass through into the washing zone tank arranged underneath, nevertheless prevents larger particles from entering the tank lying below the filter insert.

Preferably, the filter insert is designed as a suspendable box module, in which the longitudinal ribs run with a gradient in the direction of the outflow orifices formed in the bottom of the filter insert and assigned to each flume or the direction of a common outflow orifice. The gradient can be set in that the bottom, that is to say the flumes having a solid unholed surface, is/are designed to be lower-lying in the box insert in the region of the outflow orifice or outflow orifices than that side of the filter insert of box-shaped design which lies opposite the outflow orifice or outflow orifices.

Preferably, the filter insert is designed, below the longitudinal ribs of triangular design, with a free space, that is to say through the orifice patterns formed in the side faces of the longitudinal ribs, an unimpeded passage of washing water into the washing tank, arranged underneath, of the respective washing zone of the continuous-flow dishwasher is possible. Preferably, the particles entering the collecting trough through the individual flumes and the outflow orifices pass into an active filter which is formed by the filter box with an associated assembly and which can be cleaned from time to time according to the degree of soiling.

BRIEF DESCRIPTION OF THE DRAWINGS

The invention is described in more detail below with reference to the drawing in which.

EMBODIMENTS

The following versions relate to cleaning machines, in particular to continuous-flow cleaning machines, and particularly to continuous-flow dishwashers. In these, cutlery, crockery, trays and containers and the like serving for the preparation of meals are cleaned in the shortest possible time. These continuous-flow dishwashers, as a rule, comprise an endless conveyor belt, on which the batch to be cleaned either is applied directly and runs through all the treatment zones of the continuous-flow dishwasher or is accommodated in baskets which are applied to the transport medium designed, in particular, as an endless conveying slide or conveying rails, the baskets being conveyed through the treatment zones in a conveying direction and the batch contained in them at the same time being cleaned. Continuous-flow dishwashers, as a rule, optionally comprise a preclearing zone, at least one washing zone, a rinsing-clear zone or pump rinsing clear and a drying zone.

Figure 1:
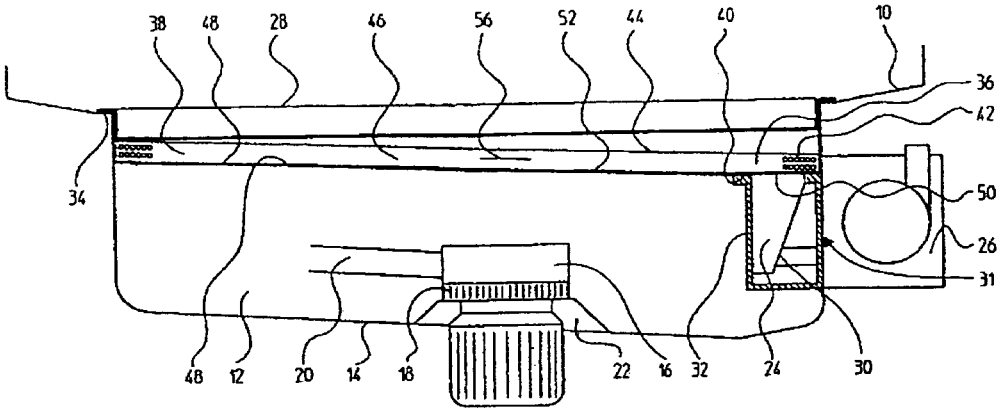
FIG. 1 shows a section through the washing tank region of a continuous-flow dishwasher.

A sectional illustration through a washing tank of a washing zone of a continuous-flow dishwasher may be gathered from the illustration according to FIG. 1.

It is apparent from the illustration according to FIG. 1 that a continuous-flow dishwasher 10, which is illustrated only partially in FIG. 1, comprises a washing tank 12 which is delimited by a tank bottom 14 on the underside. A circulating pump 16 is received in an embossed portion 22 in the tank bottom 14. The circulating pump 16 comprises, on the tank bottom side, a filter ring 18, by means of which coarse impurities are kept away from the circulating pump 16. Below the tank bottom 14, the circulating pump 16 comprises a laterally emanating pressure connection piece 20, via which a cleaning system, not illustrated in detail in FIG. 1, is acted upon, within a washing zone of the continuous-flow dishwasher 10, by circulated washing water which is applied by means of the cleaning systems, not illustrated, to the batch to be cleaned.

The circulating pump 16 is received in the embossed portion 22 in the tank bottom 14 of the washing tank 12. Above the tank bottom 14 is located a filter box 24. The filter box 24 is assigned a conveying assembly 26. The filter box 24 is connected to the conveying assembly 26 via two orifices 30, 31. Via the conveying assembly 26, which is attached laterally to a boundary wall of the washing tank 12, on the one hand, washing water accumulating in the filter box 24 is supplied for circulation and, on the other hand, the dirt filtered away is conveyed out cyclically.

Furthermore, it is apparent from the sectional illustration according to FIG. 1 that the filter box 24 is of essentially box-shaped design and is delimited by a wall 32, at the side and at the bottom. The filter box 24, in turn, constitutes a bearing surface 34 for a filter insert 36. As will also be described further below, the filter insert 36 may be designed in box form or in the form of a one-part or multipart metal sheet welded together, a plastic structure or combinations of metal sheet and plastic, which is placed or suspended in the washing tank 12 of the continuous-flow dishwasher 10.

The filter insert 36, illustrated only partially in FIG. 1, comprises a number of longitudinal ribs 38. The filter insert 36, here designed in the form of a box structure, comprises a peripheral bearing surface 34 on which a coarse screen 28 is laid. The coarse screen 28, which rests on the bearing surface 34 of the filter insert 36, is an insert part in order to keep away coarse impurities.

The longitudinal ribs 38 of the filter insert 36, illustrated only partially in FIG. 1, comprise side faces 46. The longitudinal ribs 38 have a cross section of essentially triangular design and are delimited by two side faces 46 which are connected to one another along a ridge 44 running parallel to the longitudinal ribs 38. The side faces 46 of each longitudinal rib 38 are provided continuously with an orifice pattern 42, in each case a few mm of unholed sheet metal remaining with respect to the ridge 44 and to the surface portion 53, cf. references 53 and 54 (cf. the illustration according to FIG. 5).

Although, in the illustration according to FIG. 1, an orifice pattern 42 is formed in the side faces 46 of the longitudinal ribs 38 in the filter insert 36, instead longitudinal slots or another geometry of orifices may also be formed in the side faces 46 of the longitudinal ribs 38. It is critical that, because of the small diameter or the small length or width dimensions of the orifice pattern 42 in the side faces 46, no coarse particles can pass through the filter insert 36 into the washing tank 12 of the continuous-flow dishwasher 10.

Furthermore, it may be gathered from the sectional illustration according to FIG. 1 that flumes 48 run between the individual longitudinal ribs 38. The flumes 48 are formed by a closed surface portion 52 which extends in each case between two spaced-apart longitudinal ribs 38 of the filter insert 36 and the unholed portions 53 in the longitudinal ribs 38. The flumes 48 receive particles washed off from the side faces 46 by the washing water dripping down and because of their gradient in the direction of the outflow orifice or outflow orifices 50 can flush away these particles in the direction of flow 56 in the direction of the outflow orifice 50. As illustrated in FIG. 1, the filter box 24 extends below the respective outflow orifice or outflow orifices 50.

The filter insert 36, partially reproduced in the sectional illustration in FIG. 1, comprises a number of longitudinal ribs 38 connected to one another by means of the closed surface portions 52 which form the flumes 48 for flushing-away the retained particles. As is evident from FIG. 1, the filter box 24 comprises the orifices 30, 31, via which washing water accumulated in the filter box 24 is conveyed by means of the conveying assembly 26 back into the circulation circuit, and also dirt fractions can be conveyed out.

Figure 2:
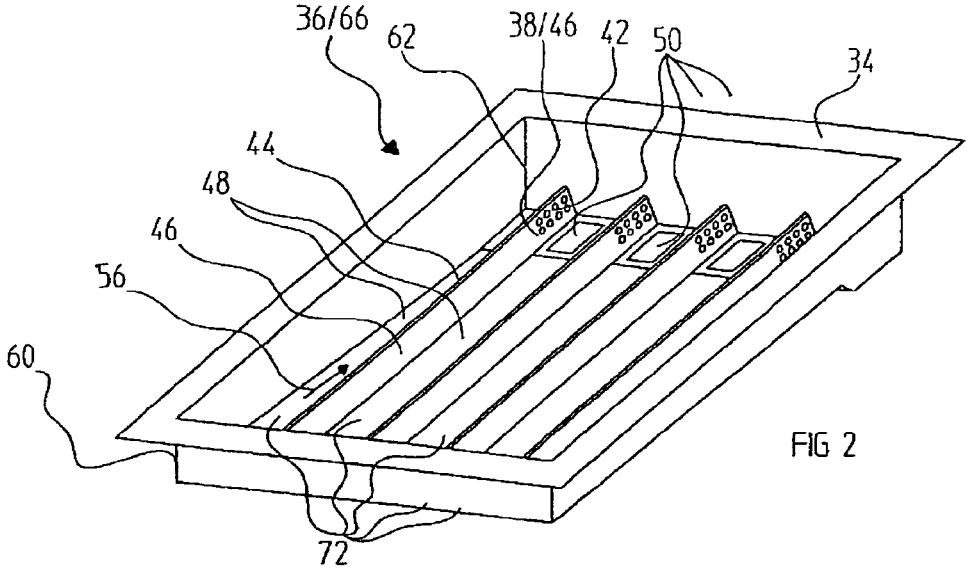
FIG. 2 shows a perspective view of the filter insert proposed according to the invention.

A perspective top view of a filter insert designed in box form may be gathered from the illustration according to FIG. 2.

Figure 5:
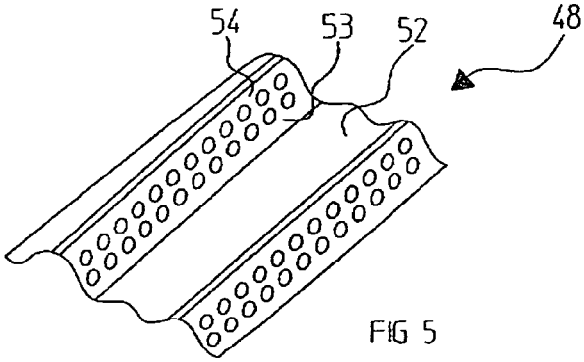
FIG. 5 shows a detail of the flume with a lateral longitudinal rib.

FIG. 2 shows that the filter insert 36 has a multiplicity of spaced-apart longitudinal ribs 38. Each of the longitudinal ribs 38 is delimited by two side faces 46 which are connected to one another in a materially integral manner along the ridge 44. In the side faces 46 is formed an orifice pattern 42, merely indicated in the illustration according to FIG. 2, which is located along the entire extent or else in part-regions of the side faces 46 of the longitudinal ribs 38 in these and has at the top and bottom unholed portions 53, 54, as illustrated in FIG. 5. It is apparent from the top view of the filter insert 36, reproduced in perspective in FIG. 2, that the individual longitudinal ribs 38 arranged essentially parallel to one another are arranged in a division 72. According to the division 72, closed surface portions 52 are obtained which with the portions 53 in the longitudinal ribs 38 form the flumes 48. The washing water, which is washed off in the respective washing zones from the batch to be cleaned and by means of which the dirt on this is released, impinges onto the longitudinal ribs 38. The liquid fraction passes through the orifice pattern 42 which is formed over the length of the longitudinal ribs 38 in the two side faces 46 connected to one another at the ridge 44. On account of the small orifice size of the orifice pattern 42 in the side faces 46 and of the upper unholed portion 54, the washing water can drip into the washing tank 12 lying below the filter insert 36, while the particles contained in the washing water slip off from the ridges 44 of the longitudinal ribs 38 and, because of the inclination of the side faces 46, from these and pass into the flumes 48. Owing to the fraction of washing water which does not pass through the orifices of the orifice pattern 42 in the side faces 46, but, instead, passes into the flumes 48, a flow in the direction of flow 56 is established in these. On account of the liquid film which is formed on the closed surface portions 52 of the flumes 48, the particles are transported, on account of the gradient 64 of the filter insert 56, in the direction of the outflow orifice or outflow orifices 50 at the end of the flumes 58, exactly through this outflow orifice or is these outflow orifices 50 into the filter box 24 arranged below the filter insert 36.

As is evident, further, from the perspective top view according to FIG. 2, the individual longitudinal ribs 38 of the filter insert 36 which are arranged parallel to one another are connected to the closed surface portions 52. For reasons connected to the drawing, the orifice pattern 42 is illustrated only in a part-region of the side faces 36 of the longitudinal ribs 38.

If the filter insert 36 is manufactured as a box insert 66, as also described below and partially illustrated in FIG. 1, then, within this box structure, that side of the flumes 48 on which the outflow orifice or outflow orifices 50 is or are formed is located at a lower level, as compared with the closed surface portion 52 of the flumes 48 of the filter insert 36, so that a flow of the washing water and an accompanying conveyance of the dirt fractions in the flumes 48 in the direction of the outflow orifices 50 is established.

It is apparent from FIG. 2 that the filter insert 36 is manufactured as a box insert 66 and is of essentially rectangular design. The filter insert 36, as a box insert 66, comprises two longitudinal and two transverse sides. Moreover, it is apparent from the perspective top view according to FIG. 2 that the individual longitudinal ribs 38 run parallel to one another and, by being arranged in the division 72, form individual flumes 48. FIG. 2 shows that the flumes 48 constitute closed surface portions and, because of the different installation depths 60 or 62 in the region of the outflow orifice or outflow orifices 50 or at the end lying opposite the outflow orifice or outflow orifices 50, have an inclination in the direction of is the outflow orifice or outflow orifices 50. In the illustration according to FIG. 5, too, it is shown that an orifice pattern 42 is formed in the side faces 46 of the individual longitudinal ribs 38.

Figure 6:
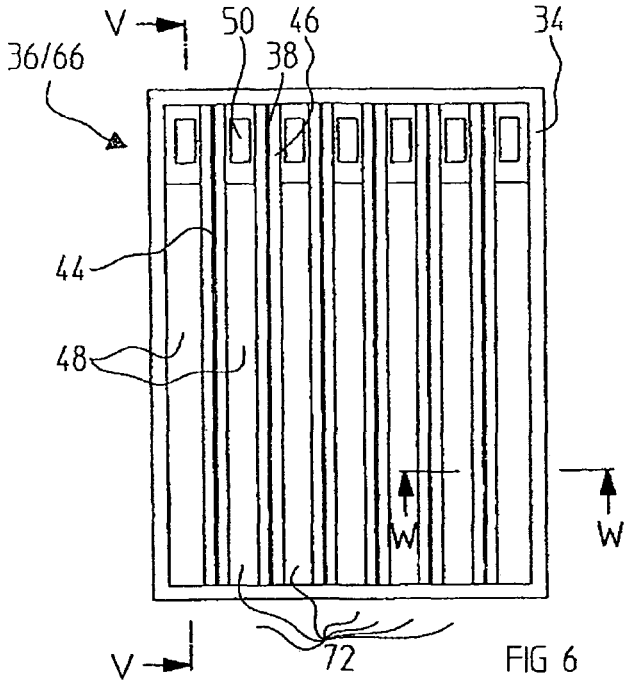
FIG. 6 shows a top view of the filter insert proposed according to the invention.

FIG. 6 shows a top view of the filter insert according to the invention designed in box form.

It is apparent from the illustration according to FIG. 6 that the filter insert 36 contains a peripheral marginal surface, designated by reference symbol 34, which serves as a bearing surface for a coarse screen 28 to be placed into the filter insert 36. By means of the coarse screen 28 lying loosely on the filter insert 36 in box form 66, the coarsest impurities are kept away from the filter insert 36 and are screened out even before reaching the filter insert 36.

As shown, further, in FIG. 6, longitudinal ribs 38 arranged in the division 72 run parallel to one another. The longitudinal ribs 38 in each case have side faces 46 which are connected to one another in a materially integral manner at their upper end along a ridge 44. Each of the side faces 46 of the longitudinal ribs 38 comprises the orifice pattern 42 which, for reasons connected to the drawing, is merely indicated on each of the longitudinal ribs 38 in the illustration according to FIGS. 1 and 5.

It is apparent from FIG. 6 that the individual flumes 48 are formed in each case by a side face 46 of two longitudinal ribs 38 arranged adjacently to one another. A width of the closed surface portions 52 forming the flumes 48 is established according to the division 72 (cf. FIG. 8).

Figure 3:
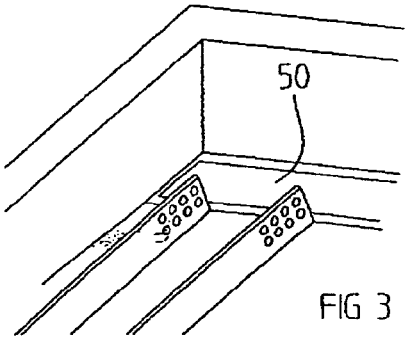
FIGS. 3 and 4 show embodiments of the outflow orifice.
Figure 4:
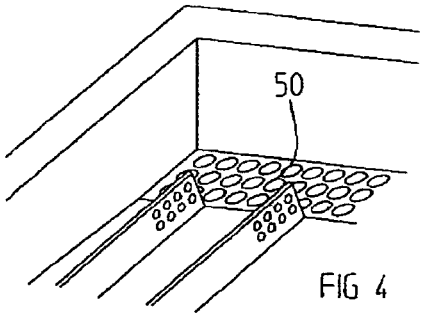

Moreover, it is apparent from the illustration according to FIG. 6 that the outflow orifice or outflow orifices 50 according to FIGS. 2, 3 and 4 is or are of essentially rectangular design and is or are designed in box form 66 in the bottom of the filter insert 36 at the end of the flumes 48 formed by the closed surface portions 52.

Figure 7:
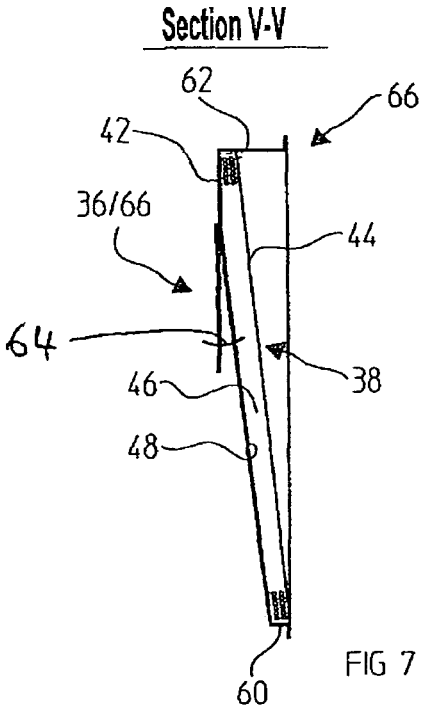
FIG. 7 shows a sectional illustration of the filter insert illustrated in a top view in FIG. 6 and proposed according to the invention, along the sectional line V-V in FIG. 6.

FIG. 7 shows a section through the filter insert according to FIG. 6 along the sectional line V-V.

It can be gathered from the sectional line illustrated in FIG. 7 that the filter insert 36, designed in box form 66, has a standing surface 54 which is formed essentially by the underside of the closed surface portions 52. Furthermore, it is apparent from FIG. 7 that the second installation depth 62 of the flumes 48 in the region of the outflow orifice or outflow orifices 50 is greater than the first installation depth 60 at that end of the flumes 48 in the filter insert 36 which lies opposite the outflow orifice or outflow orifices 50. This gives rise to the gradient 64. In the sectional illustration according to FIG. 7, too, the orifice pattern 42 in the side faces 46 of the longitudinal ribs 38 is indicated. In each case two side faces 46 with an orifice pattern 42 are connected to one another along the ridge 44 which forms the top side of each of the longitudinal ribs 38.

It can be gathered from the perspective top view according to the illustration in FIG. 2 that the filter insert 36 in box form 66 comprises the bearing surface 34 for the coarse screen 28 having larger orifices and retaining coarse impurities. In the illustration according to FIG. 2, the first installation depth 60 and the second installation depth 62 are illustrated, by means of which the gradient is imparted to the closed surface portions 52 forming the flumes 48. On account of the gradient of each of the flumes 48, a transport of impurities in the direction of flow 56 in the direction of the outflow orifices 50 at the end of the flumes 48 is established.

Figure 8:
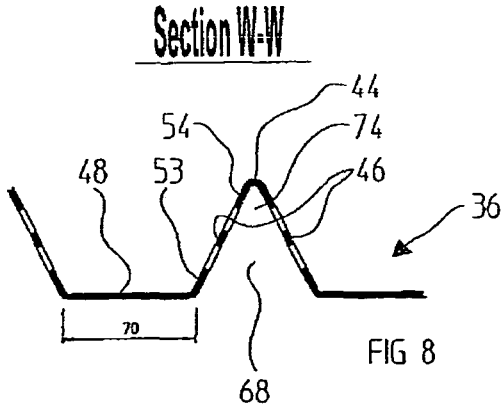
FIG. 8 shows a sectional illustration of the filter insert illustrated in a top view in FIG. 6 and proposed according to the invention, along the sectional line W-W in FIG. 6.

A section through the filter insert proposed according to the invention may be gathered from the illustration according to FIG. 8.

It is apparent from FIG. 8 that a resulting width 70 of the flumes 48 is established according to the division 72 of the filter insert 36 with respect to the arrangement of the longitudinal ribs 38. Each of the flumes 48 is formed by the unholed portions 53 of one of the side faces 46 of two longitudinal ribs 38 arranged adjacently to one another and the closed surface portion 52. Each of the longitudinal ribs 38 has a free space 68, through which the washing water passing through the orifices of the orifice pattern 42 in each of the side faces 46 drips in the direction of the washing tank 12 of the continuous-flow dishwasher 10. It can be gathered, further, from the illustration according to FIG. 8 that the two side faces 46, which in each case form a longitudinal rib 38, form at the ridge 44 an angle 74 which preferably lies between 15° and 35°. What is achieved thereby is that the two side faces 46 of each of the longitudinal ribs 38 are very steep with respect to the flumes 48. As a result, and because of the closed surfaces 54 in the ridge region, the washing water dripping down continuously from the top side can wash off particles adhering to the side faces 46 into the respective flumes 48.

LIST OF REFERENCE SYMBOLS

10 Continuous-flow 68 Free-space dishwasher
12 Washing tank 70 Width flume
14 Tank bottom
16 Circulating pump 72 Division flume/longitudinal ribs
18 Filter ring 74 Angle below ridge 44
20 Pressure connection piece
22 Embossed portion tank bottom
24 Filter box
26 Conveying assembly
28 Coarse screen
30 Orifice for sewerage
31 Orifice for sewerage
32 Boundary wall filter box
34 Bearing surface coarse screen
36 Filter insert
38 Longitudinal rib
40 Bearing surface filter insert
42 Orifice pattern
44 Ridge longitudinal rib
46 Side face longitudinal rib
48 Flume
50 Outflow orifice
52 Closed surface portion
53 Unperforated portion (bottom)
54 Unperforated portion (top)
56 Direction of flow flume film
58 Orientation filter insert
60 First installation depth
62 Second installation depth
64 Gradient
66 Box insert with a bearing surface 34 for coarse screen

The invention claimed is:

1. A filter insert for cleaning machines, in particular continuous-flow dishwashers, in which a batch to be cleaned runs through at least one treatment zone, the at least one treatment zone being assigned a washing tank, wherein the filter insert has a number of longitudinal ribs which run parallel to one another and delimit flumes, and wherein side faces of the longitudinal ribs are perforated and a bottom of the flumes has a closed surface.

2. The filter insert as claimed in claim 1, wherein the filter insert further includes a connection component for connection to the washing tank of the at least one treatment zone, above a circulating pump.

3. The filter insert as claimed in claim 2, wherein the connection component comprises a peripheral bearing surface for retaining a coarse screen.

4. The filter insert as claimed in claim 1, wherein the filter insert has a peripheral bearing surface for a coarse screen retaining coarser impurities.

5. The filter insert as claimed in claim 1, wherein the filter insert is designed in box form.

6. The filter insert as claimed in claim 1, wherein said longitudinal ribs are arranged in a division.

7. The filter insert as claimed in claim 1, wherein the longitudinal ribs have an essentially triangular cross section.

8. The filter insert as claimed in claim 7, wherein the longitudinal ribs are formed from side faces which are connected to one another along a ridge extending parallel to the flumes.

9. The filter insert as claimed in claim 7, wherein the side faces forming the longitudinal ribs have an orifice pattern, the orifices of which have a smaller cross section than a coarse screen covering the filter insert.

10. The filter insert as claimed in claim 7, wherein the side faces of the longitudinal ribs form at the ridge a taper angle which lies between 15° and 35°.

11. The filter insert as claimed in claim 1, wherein a bottom surface, in particular, of the filter insert in box form has an essentially zigzag-shaped profile.

12. The filter insert as claimed in claim 1, wherein, below each of the longitudinal ribs of the filter insert, a free space runs, through which washing water passing through the side faces of the longitudinal ribs drips off into the washing tank.

13. The filter insert as claimed in claim 1, wherein a width of a respective flume which is delimited by two longitudinal ribs corresponds to a division of the filter insert.

14. The filter insert as claimed in claim 1, wherein said flumes have outflow orifices or issue into a common outflow.

15. The filter insert as claimed in claim 1, wherein the flumes are arranged in a gradient.

16. The filter insert as claimed in claim 1, wherein the flumes are arranged with an inclination in a direction toward an outflow orifice.

17. The filter insert as claimed in claim 1, wherein the longitudinal ribs are connected to each other by closed surface portions.

18. The filter insert as claimed in claim 1, wherein the flumes are configured to flush away retained particles.

19. A filter insert for cleaning machines, the filter insert comprising:

parallel longitudinal ribs;

an orifice opening;

closed surface portions connecting the longitudinal ribs to form flumes; and an orifice pattern formed on a portion of a side face of the parallel longitudinal ribs, wherein a bottom of the flumes has a closed surface, and wherein the flumes are inclined in a direction toward the orifice opening.

* * * * *

UNITED STATES PATENT AND TRADEMARK OFFICE

CERTIFICATE OF CORRECTION

PATENT NO. : 8,746,461 B2
APPLICATION NO. : 12/030721
DATED : June 10, 2014
INVENTOR(S) : Gaus et al.

It is certified that error appears in the above-identified patent and that said Letters Patent is hereby corrected as shown below:

Title Page, Item (12) "Costa" should read -- Gaus, et al. --.

Title Page, Item (72) Inventor is corrected to read:
-- Bruno Gaus, Offenburg (DE);
Denis Lehmann, Offenburg (DE) --.

Signed and Sealed this
Second Day of February, 2016

Michelle K. Lee

Michelle K. Lee
*Director of the United States Patent and Trademark Office*